US005725263A

United States Patent [19]

Rodriguez

[11] Patent Number: 5,725,263

[45] Date of Patent: Mar. 10, 1998

[54] DOOR SECURING DEVICE

[76] Inventor: Ernest L. Rodriguez, 15736 Wedgeworth Dr., Hacienda Heights, Calif. 91745

[21] Appl. No.: 825,758

[22] Filed: Apr. 3, 1997

[51] Int. Cl.[6] ..... E05C 17/44

[52] U.S. Cl. ..... 292/338; 292/DIG. 15; 292/142; 292/342; 16/82

[58] Field of Search ..... 292/338, DIG. 15, 292/342, 343, 142, 183, 141; 16/82

[56] References Cited

U.S. PATENT DOCUMENTS

| | | | |
|---|---|---|---|
| 453,930 | 6/1891 | La Follette | 292/DIG. 15 |
| 528,049 | 10/1894 | Wertzberger | 292/DIG. 15 |
| 534,590 | 2/1895 | Wallace | 292/343 |
| 624,941 | 5/1899 | Jensen | 292/DIG. 15 |
| 1,005,849 | 10/1911 | Lange et al. | 292/DIG. 15 |
| 1,081,634 | 12/1913 | Smith | 292/DIG. 15 |
| 1,661,240 | 3/1928 | Trimbach | 292/338 |
| 4,213,315 | 7/1980 | Lewis | 292/DIG. 15 |
| 4,569,546 | 2/1986 | Howard et al. | 292/DIG. 15 |
| 5,346,266 | 9/1994 | Bisbing | 292/142 |
| 5,618,072 | 4/1997 | Pitchford | 292/DIG. 15 |

*Primary Examiner*—Darnell M. Boucher

[57] ABSTRACT

A door securing device including an upper housing member being mounted about a door knob rose. The upper housing member encasing a locking mechanism with a trigger. A lower housing member is mounted to a lower door portion and has a bottom opening. The lower housing member has a rear wall with a pair of sprocket frames projection therefrom. A cable guard with a cable is coupled with the trigger. The cable guard is coupled with the upper housing member and the lower housing member. A door stop mechanism is housed within the lower housing member. The door stop mechanism has a stop wedge with a top side having a track, and a bottom side with a stopper. The door stop mechanism has a first sprocket member and a second sprocket member that rotatably coupled between the pair of sprocket frames. The first member capable of engaging the track. Included is a chain for engaging the first and second sprocket members. The chain is coupled with the cable for allowing the chain to be pulled when the trigger is rotated, and allowing simultaneously rotation of the first and second sprocket, for moving the first sprocket along the track, for movement of the stopper within the bottom opening. Lastly, a pair of guide plates are provided. Each has a fixed guide rod and each is mounted to the stop wedge block. The fixed guide rods is capable of guiding the movement of the stop wedge block about the first sprocket.

11 Claims, 3 Drawing Sheets

DOOR SECURING DEVICE

BACKGROUND OF THE INVENTION

1. Field of the Invention

The present invention relates to a door securing device and more particularly pertains to providing a device that is mounted to the existing door and further prevents unwanted entry through a door way by providing a stopper movable with a trigger.

2. Description of the Prior Art

The use of door stop is known in the prior art. More specifically, door stops heretofore devised and utilized for the purpose of wedging a door are known to consist basically of familiar, expected and obvious structural configurations, notwithstanding the myriad of designs encompassed by the crowded prior art which have been developed for the fulfillment of countless objectives and requirements.

By way of example, the prior art includes U.S. Pat. No. 5,333,922 to Jones discloses a portable door secure system. U.S. Pat. No. 4,676,536 to Arbic, Love and Kramer discloses a door brace. U.S. Pat. Des. No. 290,579 to Crisp and Davidson discloses a door security brace. U.S. Pat. No. 4,605,250 to Simo-Company discloses an internal brake for doors. U.S. Pat. No. 4,601,502 to Van Dyke discloses a door stop assembly. Lastly, U.S. Pat. No. 4,494,784 to Haynes discloses a doorstop for the handicapped.

In this respect, the door securing device according to the present invention substantially departs from the conventional concepts and designs of the prior art, and in so doing provides an apparatus primarily developed for the purpose of providing a device that is mounted to the existing door and further prevents unwanted entry through a door way by providing a stopper movable with a trigger.

Therefore, it can be appreciated that there exists a continuing need for a new and improved door securing device which can be used for providing a device that is mounted to the existing door and further prevents unwanted entry through a door way by providing a stopper movable with a trigger. In this regard, the present invention substantially fulfills this need.

SUMMARY OF THE INVENTION

In view of the foregoing disadvantages inherent in the known types of door stops now present in the prior art, the present invention provides an improved door securing device. As such, the general purpose of the present invention, which will be described subsequently in greater detail, is to provide a new and improved door securing device which has all the advantages of the prior art and none of the disadvantages.

To attain this, the present invention essentially comprises an upper housing member that is mounted about a door knob rose. The upper housing member has a front panel and a bottom end. The upper housing member encases a locking mechanism with a trigger. The trigger of the locking mechanism projects outwardly from the front panel of the upper housing member. A lower housing member is mounted to a lower door portion, and spaced from the upper housing member. The lower housing member has a short front wall, and a rear wall and a pair of side walls connecting with a top portion. The lower housing member has an upper panel coupling with the top portion and short front wall. The lower housing member has a bottom opening. The rear wall of the lower housing has a pair of sprocket frames projecting therefrom and in the direction of the short front wall. A cable guard with a cable therein is provided. The cable guard is coupled with the bottom end of the upper housing member and the top portion of the lower housing member. The cable has a first end and a second end. The first end of the cable is coupled with the trigger of the upper housing member. A door stop mechanism is housed within the lower housing member. The door stop mechanism has a stop wedge block with a top side, a bottom side, a front side and a back side. The top side of the stop wedge block has a decreasing height from front side to back side. The top side has a track centrally mounted thereon and below the pair of socket frames of the lower housing member. The bottom side has a stopper that is fixedly attached thereto and capable of projecting from the bottom opening of the lower housing member. Included is a first sprocket member being rotatably coupled between the pair of sprocket frames for engaging the track of the door stop mechanism. The first sprocket member has a plurality of spokes.

Included is a second sprocket member that is rotatably coupled between the pair of sprocket frames and spaced from the first sprocket. The second sprocket member has a plurality of spokes with a chain thereon. The chain has an end link that is coupled with the second end of the cable. The chain is coupled with the cable for allowing the chain to be pulled when the trigger is rotated, and allowing simultaneously rotation of the first and second sprocket for moving the first sprocket along the track. The first sprocket, when moved along the track being capable of moving the stop wedge block back and forth at an incline for raising and lowering the stopper in and out of the bottom opening for alternating engagement of a receiving surface. Lastly, a pair of guide plates are mounted to the stop wedge block. Each guide plate has a fixed guide rod positioned therein. Each fixed guide rod is mounted at one end to the short front wall of the lower housing member and another end to the rear wall of the lower housing. The fixed guide rods are capable of guiding the movement of the stop wedge block about the first sprocket.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved door securing device which has all the advantages of the prior art door stops and none of the disadvantages.

It is another object of the present invention to provide a new and improved door securing device which may be easily and efficiently manufactured and marketed.

It is a further object of the present invention to provide a new and improved door securing device which is of a durable and reliable construction.

An even further object of the present invention is to provide a new and improved door securing device which is susceptible of a low cost of manufacture with regard to both materials and labor, and which accordingly is then susceptible of low prices of sale to the consuming public, thereby making such door securing device economically available to the buying public.

Still yet another object of the present invention is to provide a new and improved door securing device which provides in the apparatuses and methods of the prior art some of the advantages thereof, while simultaneously overcoming some of the disadvantages normally associated therewith.

Still another object of the present invention is to providing a device that is mounted to the existing door and further prevents unwanted entry through a door way by providing a stopper movable with a trigger.

Lastly, it is an object of the present invention to provide a new and improved door securing device that has an upper housing member being mounted about a door knob rose. The upper housing member encasing a locking mechanism with a trigger. A lower housing member is mounted to a lower door portion and has a bottom opening. The lower housing member has a rear wall with a pair of sprocket frames projection therefrom. A cable guard with a cable is coupled with the trigger. The cable guard is coupled with the upper housing member and the lower housing member. A door stop mechanism is housed within the lower housing member. The door stop mechanism has a stop wedge with a top side having a track, and a bottom side with a stopper. The door stop mechanism has a first sprocket member and a second sprocket member that rotatably coupled between the pair of sprocket frames. The first member capable of engaging the track. Included is a chain for engaging the first and second sprocket members. The chain is coupled with the cable for allowing the chain to be pulled when the trigger is rotated, and allowing simultaneously rotation of the first and second sprocket, for moving the first sprocket along the track, for movement of the stopper within the bottom opening. Lastly, a pair of guide plates are provided. Each has a fixed guide rod and each is mounted to the stop wedge block. The fixed guide rods is capable of guiding the movement of the stop wedge block about the first sprocket.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

Similar reference characters refer to similar parts throughout the several views of the drawings.

DESCRIPTION OF THE PREFERRED EMBODIMENT

Figure 1:
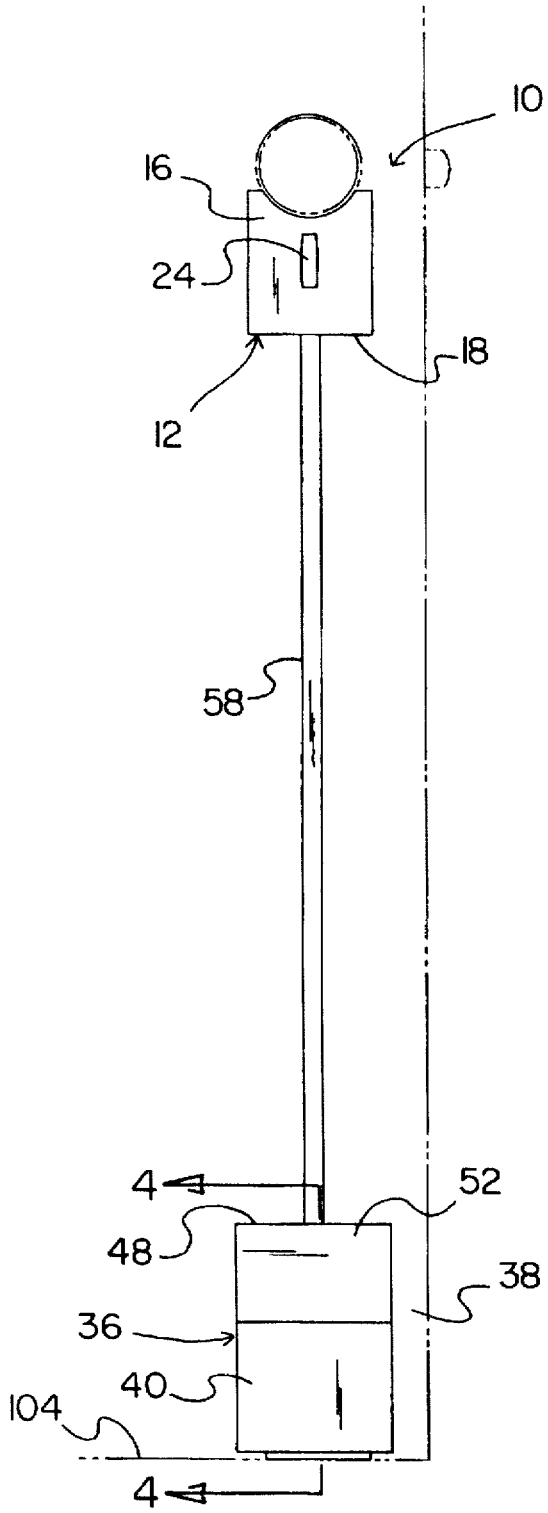
FIG. 1 is a perspective illustration of the preferred embodiment of the door securing device constructed in accordance with the principles of the present invention.

With reference now to the drawings, and in particular to FIG. 1 thereof, a new and improved door securing device embodying the principles and concepts of the present invention and generally designated by the reference numeral 10 will be described.

The present invention, the new and improved door securing device, is comprised of a plurality of components. Such components in their broadest context include an upper and lower housing member, a locking mechanism and a door stop mechanism. Such components are individually configured and correlated with respect to each other so as to attain the desired objective.

Figure 2:
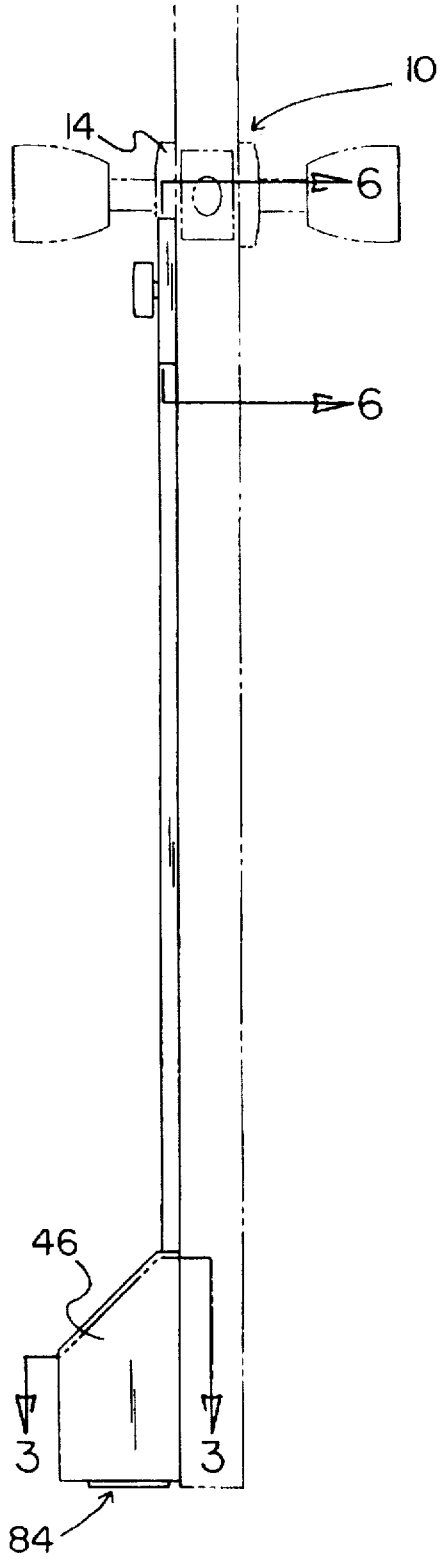
FIG. 2 is a side view of the preferred embodiment of the door securing device of the present invention.

More specifically, it will be noted that an upper housing member 12 is included. The upper housing member, as seen in FIG. 2, is mounted about a door knob rose 14. The upper housing member has a front panel 16, and a bottom end 18. The upper housing member encases a locking mechanism 22 with a trigger 24. The locking mechanism is a disk member 26 with an eyelet 28 attached. The trigger is turned clockwise and counter-clockwise to rotate the disk member. When the trigger is turned the eyelet is moved from a vertical orientation to a horizontal orientation, a shown in FIG. 6. The trigger of the locking mechanism projects outwardly from the front panel of the upper housing member. Mounted interior the upper housing member is a cable guide 32. The cable guide is spaced from the bottom end of the upper housing member.

Figure 3:
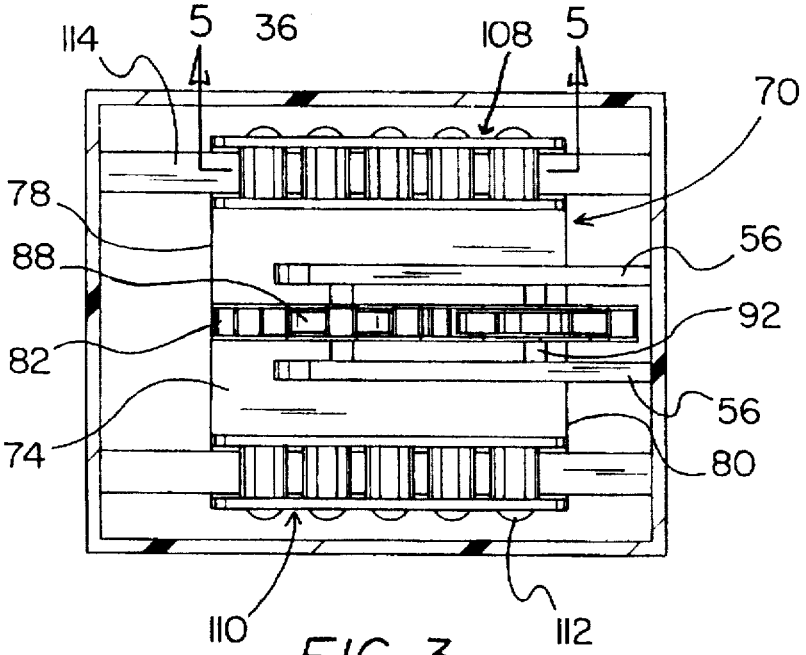
FIG. 3 is a top view of the door stop mechanism of the present invention in an operable orientation and taken along line 3—3 of FIG. 2.

Included is a lower housing member 36. FIGS. 1 and 2 show the lower housing member mounted to a lower door portion 38, and spaced from the upper housing member. The lower housing member has a short front wall 40, and a rear wall 42 and a pair of side walls 44 and 46. The short front wall, the rear wall and each side wall are connected with a top portion 48. To close the upper portion of the lower housing member an upper panel 52 is coupled with the top portion and short front wall. As seen in FIG. 2, the upper panel slops downward. The lower housing member has a bottom opening 54. The rear wall of the lower housing has a pair of sprocket frames 56. As depicted in FIG. 3, the sprocket frames project for the rear wall and in the direction of the short front wall.

Figure 4:
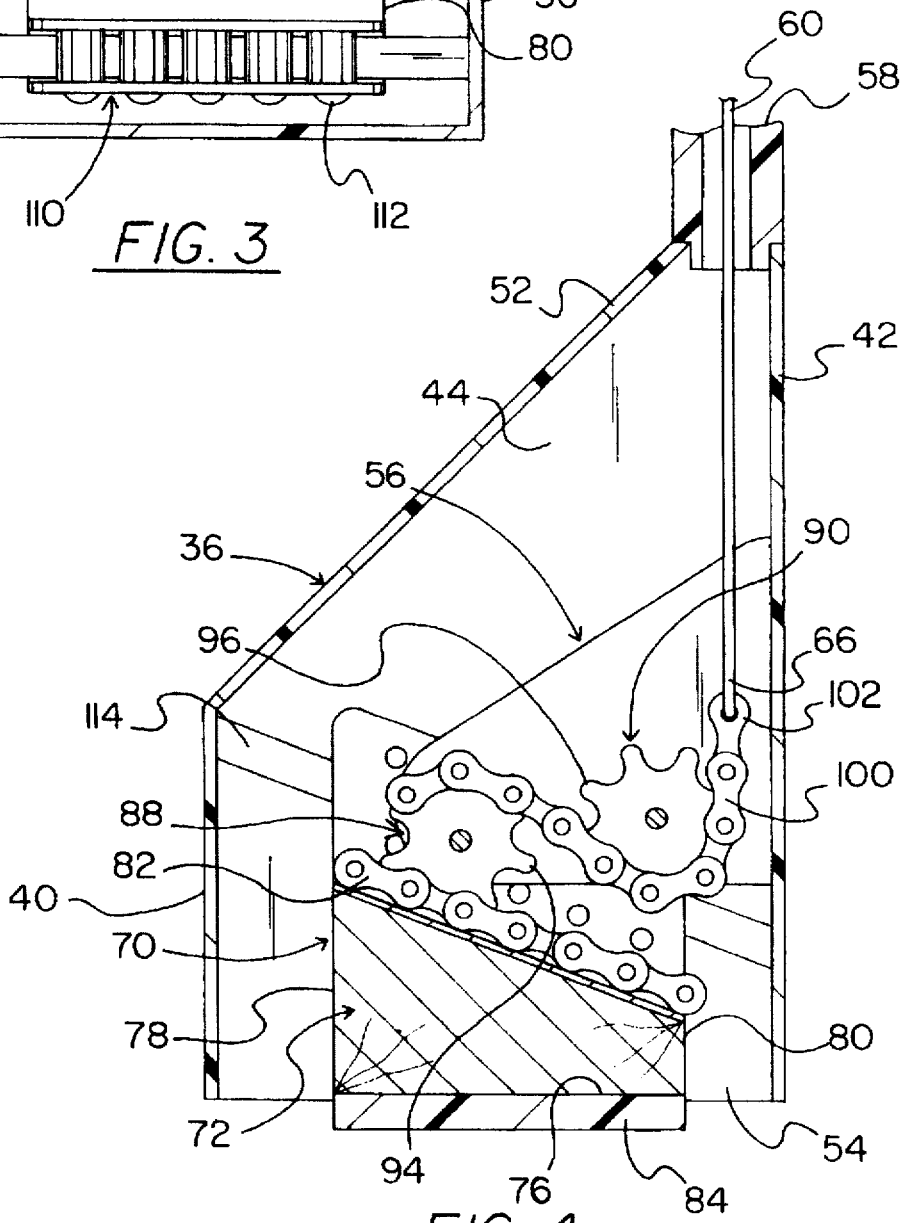
FIG. 4 is a cross-sectional view of the present invention taken along line 4—4 of FIG. 1.
Figure 6:
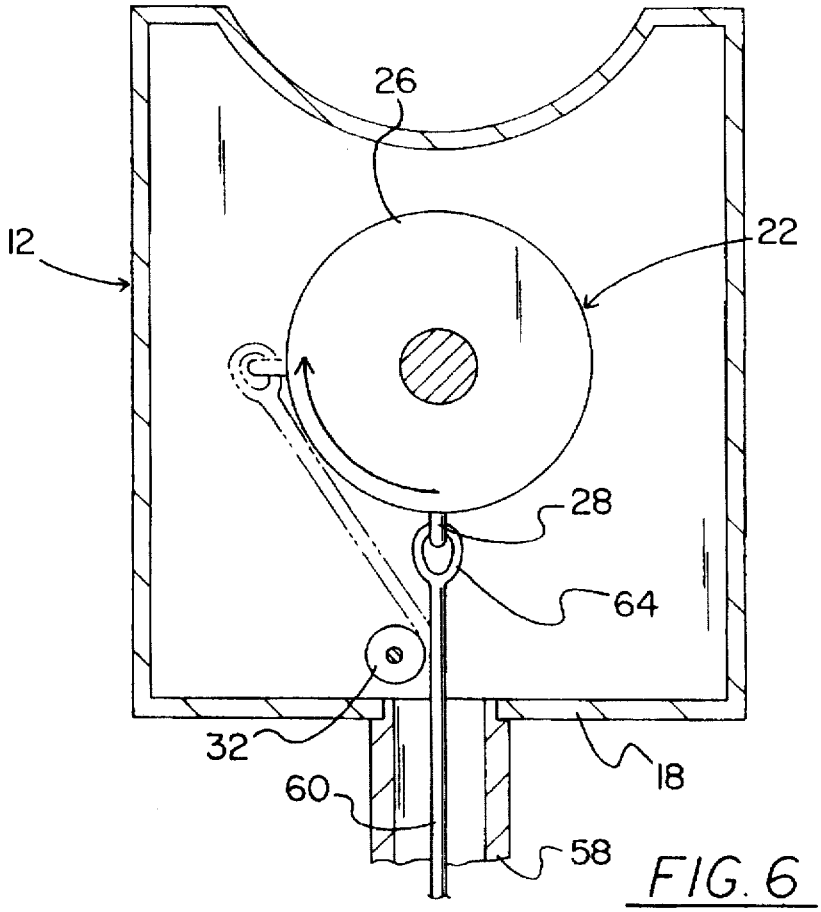
FIG. 6 is a cross sectional view of the locking mechanism taken along line 6—6 of FIG. 2.

As illustrated in FIG. 1, a cable guard 58 is provided and has a cable 60 within. The cable guard is coupled with the bottom end 18 of the upper housing member and the top portion 48 of the lower housing member. FIG. 6 shows the cable having a first end 64 that is coupled with the eyelet of the trigger 22 of the upper housing member. FIG. 4 shown that the cable has a second end 66 that is positioned within the lower housing member.

Figure 5:
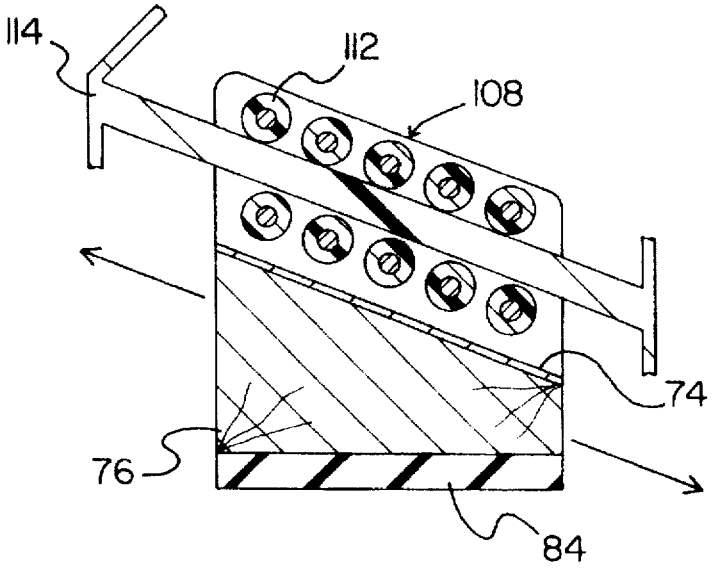
FIG. 5 is a cross-sectional view of the present invention taken along line 5—5 of FIG. 3.

Also, a door stop mechanism 70 is housed within the lower housing member, as seen in FIG. 3. The door stop mechanism is comprised of a variety of components. These components are a stop wedge block 72 with a top side 74, a bottom side 76, a front side 78 and a back side 80. As shown in FIG. 5, the top side of the stop wedge block has a decreasing height from front side to back side. The top side has a track 82 that is centrally mounted thereon and below the pair of socket frames 56 of the lower housing member. The bottom side has a stopper 84 that is fixedly attached. The stopper is made from a non-scuff flexible material. The stopper is capable of projecting from the bottom opening of the lower housing member, as shown in FIG. 2.

Additionally a first sprocket member 88 and a second sprocket member 90 are each rotatably coupled to the pair of sprocket frames. Each sprocket member is supported by a axle rod 92. The first sprocket member has a plurality of spokes. Each spoke of the first sprocket member engages the track 82 when the first sprocket member is rotatably coupled between the pair of sprocket frames of the door stop mechanism 70. The second sprocket member is spaced from the first sprocket. The second sprocket member has a plurality of spokes 96.

A chain 100 is included. The chain has an end link 102 that is coupled with the second end 66 of the cable. As seen in FIG. 4, the chain, when coupled with the cable, allows the chain to be pulled by the trigger when the trigger is rotated. Pulling the chain allows simultaneous rotation of the first and second sprocket 90 and moves the first sprocket 88 along the track. As the first sprocket is moved along the track, the stop wedge block is moved back and forth at an incline for raising and lowering the stopper in and out of the bottom opening. The direction of movement of the stop wedge block is shown in FIG. 5. Moving the stop wedge block allows the stopper to alternate engagement of a receiving surface 104.

Lastly, a pair of guide plates 108 and 110 are mounted to the stop wedge block 72. Each guide plate has a plurality of rollers 112. The plurality of rollers of each guide plate are line up in a series of 5 in a row and are offset slightly, as shown in FIG. 5, along a top and bottom row. Each guide plate has a fixed guide rod 114 positioned within and between the upper and lower series of rollers. As depicted in FIG. 4, each fixed guide rod is mounted at one end to the short front wall 40 of the lower housing member and another end to the rear wall 42 of the lower housing. The fixed guide rods guide the movement of the stop wedge block about the first sprocket.

The present invention door securing device is a specially designed security door lock featuring a trigger-controlled mechanism. One component of the device consist of the trigger within an upper housing member. The trigger has an eyelet that is attached to a cable. The cable passes into a cable guard that is coupled with a lower housing member. The lower housing member is attached to the lower portion of a door. The lower housing member contains the door stop mechanism. The door stop mechanism has a stop wedge block with a hard rubber stopper attached. When the trigger is in the open position the stop wedge block is pulled into the lower housing member and leaves a gap between the lower housing member and the floor. When the trigger is in the neutral position, the stopper of the stop wedge block is positioned against the floor. Other components of the door stop mechanism are a pair of rolled frames/guide plates, a flexible cable, two sets of chain. One set operates as a track when mounted to the top side of the stop wedge block. Another of the chains is coupled with the flexible cable. Pulling the chain coupled with the cable, by turning the trigger, moves the stop wedge block along a pair of fixed guide rod. Each fixed guide rod is supported by the roller frame.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A door securing device for preventing the entrance of intruders comprising in combination:

an upper housing member being mounted about a door knob rose, the upper housing member having a front panel and a bottom end, the upper housing member encasing a locking mechanism with a trigger, the trigger of the locking mechanism projecting outwardly from the front panel of the upper housing member;

a lower housing member being mounted to a lower door portion and spaced from the upper housing member, the lower housing member having a short front wall, and a rear wall and a pair of side walls connecting with a top portion, the lower housing member having an upper panel coupling with the top portion and short front wall, the lower housing member having a bottom opening, the rear wall of the lower housing having a pair of sprocket frames projection therefrom and in the direction of the short front wall;

a cable guard with a cable therein, the cable guard being coupled with the bottom end of the upper housing member and the top portion of the lower housing member, the cable having a first end and a second end, the first end of the cable being coupled with the trigger of the upper housing member;

a door stop mechanism being housed within the lower housing member, the door stop mechanism having a stop wedge block with a top side, a bottom side, a front side and a back side, the top side of the stop wedge block having a decreasing height from front side to back side, the top side having a track centrally mounted thereon and below the pair of socket frames of the lower housing member, the bottom side having a stopper being fixedly attached thereto and capable of projecting from the bottom opening of the lower housing member;

a first sprocket member being rotatably coupled between the pair of sprocket frames for engaging the track of the door stop mechanism, the first sprocket member having a plurality of spokes;

a second sprocket member being rotatably coupled between the pair of sprocket frames and spaced from the first sprocket, the second sprocket member having a plurality of spokes with a chain thereon, the chain having an end link being coupled with the second end of the cable, the chain being coupled with the cable for allowing the chain to be pulled when the trigger being rotated, and allowing simultaneously rotation of the first and second sprocket for moving the first sprocket along the track, the first sprocket when moved along the track being capable of moving the stop wedge block back and forth at an incline for raising and lowering the stopper in and out of the bottom opening for alternating engagement of a receiving surface; and a pair of guide plates being mounted to the stop wedge block, each guide plate having a fixed guide rod positioned therein, each fixed guide rod being mounted at one end to the short front wall of the lower housing member and another end to the rear wall of the lower housing, the fixed guide rods being capable of guiding the movement of the stop wedge block about the first sprocket.

2. A door securing device comprising:

an upper housing member adapted to be mounted about a door knob rose, the upper housing member encasing a locking mechanism with a trigger;

a lower housing member adapted to be mounted to a lower door portion and having a bottom opening, the lower housing member having a rear wall with a pair of sprocket frames projecting therefrom;

a cable guard with a cable therein for coupling with the trigger, the cable guard being coupled with the upper housing member and the lower housing member;

a door stop mechanism being housed within the lower housing member, the door stop mechanism having a stop wedge with a top side having a track, and a bottom side with a stopper, the door stop mechanism having a first sprocket member and a second sprocket member being rotatably coupled between the pair of sprocket frames, the first member capable of engaging the track;

a chain for engaging the first and second sprocket members, the chain being coupled with the cable for allowing the chain to be pulled when the trigger is being rotated, and allowing simultaneously rotation of the first and second sprocket for moving the first sprocket along the track and the stopper within the bottom opening; and a pair of guide plates with each having a fixed guide rod and each being mounted to the stop wedge block, the fixed guide rods being capable of guiding the movement of the stop wedge block about the first sprocket.

3. The door securing device as set forth in claim 2, wherein the upper housing member having a front panel and a bottom end being connected with the cable guard, and the trigger of the locking mechanism projecting outwardly from the front panel of the upper housing member.

4. The door securing device as set forth in claim 2, wherein the lower housing member being spaced from the upper housing member.

5. The door securing device as set forth in claim 4, wherein the lower housing member having a short front wall, and a rear wall and a pair of side walls connecting with a top portion, and the lower housing member having an upper panel coupling with the top portion and short front wall.

6. The door securing device as set forth in claim 2, wherein the cable having a first end and a second end, the first end of the cable being coupled with the trigger of the upper housing member for allowing up and down movement of the cable with the trigger.

7. The door securing device as set forth in claim 2, wherein the stop wedge block having a front side and a back side, the top side of the stop wedge block having a decreasing height from front side to back side, and the track being centrally mounted on the top side of the stop block wedge and below the pair of socket frames of the lower housing member.

8. The door securing device as set forth in claim 2, wherein the stopper being fixedly attached to the bottom side and capable of projecting from the bottom opening of the lower housing member.

9. The door securing device as set forth in claim 2, wherein the first sprocket member having a plurality of spokes and the second sprocket member having a plurality of spokes and being spaced from the first sprocket.

10. The door securing device as set forth in claim 2, wherein the chain having an end link being coupled with the second end of the cable and the first sprocket when moved along the track being capable of moving the stop wedge block back and forth at an incline for raising and lowering the stopper in and out of the bottom opening for alternating engagement of a receiving surface.

11. The door securing device as set forth in claim 5, wherein each fixed guide rod being mounted at one end to the short front wall of the lower housing member and another end to the rear wall of the lower housing.

* * * * *